US008425695B2

(12) United States Patent
Hayakawa et al.

(10) Patent No.: US 8,425,695 B2
(45) Date of Patent: Apr. 23, 2013

(54) RARE EARTH SINTERED MAGNET

(75) Inventors: Takuma Hayakawa, Tokyo (JP); Ryouta Kunieda, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/179,235

(22) Filed: Jul. 8, 2011

(65) Prior Publication Data

US 2012/0024429 A1 Feb. 2, 2012

(30) Foreign Application Priority Data

Jul. 27, 2010 (JP) ..... 2010-168570

(51) Int. Cl.
*H01F 1/057* (2006.01)

(52) U.S. Cl.
USPC ..... 148/302; 148/101; 148/103; 420/83; 420/121

(58) Field of Classification Search ..... None
See application file for complete search history.

(56) References Cited

U.S. PATENT DOCUMENTS 5,110,374 A * 5/1992 Takeshita et al. ..... 148/101
2004/0177899 A1* 9/2004 Nishizawa et al. ..... 148/302
2004/0187969 A1* 9/2004 Ishizaka et al. ..... 148/302

FOREIGN PATENT DOCUMENTS

JP A-2003-31409 1/2003

* cited by examiner

*Primary Examiner* — John Sheehan
(74) *Attorney, Agent, or Firm* — Oliff & Berridge, PLC

(57) ABSTRACT

A rare earth sintered magnet includes a main phase that includes an $R_2T_{14}B$ phase of crystal grain where R is one or more rare earth elements including Nd, T is one or more transition metal elements including Fe or Fe and Co, and B is B or B and C; a grain boundary phase in which a content of R is larger than a content of the $R_2T_{14}B$ phase; and a grain boundary triple point that is surrounded by three or more main phases. The grain boundary triple point includes an R75 phase containing R of 60 at % to 90 at %, Co, and Cu. The relational expression $0.05 \leqq (Co+Cu)/R < 0.5$ is satisfied. An area where a Co-rich region overlaps with a Cu-rich region in a cross-sectional area of the grain boundary triple point is 60% or more.

4 Claims, 11 Drawing Sheets
(6 of 11 Drawing Sheet(s) Filed in Color)

RARE EARTH SINTERED MAGNET

CROSS-REFERENCE TO RELATED APPLICATIONS

This application is based upon and claims the benefit of priority from Japanese Patent Application No. 2010-168570, filed on Jul. 27, 2010, the entire contents of which are incorporated herein by reference.

BACKGROUND OF THE INVENTION

1. Field of the Invention

The present invention relates to a rare earth sintered magnet with improved corrosion resistance.

2. Description of the Related Art

A rare earth permanent magnet having an R-T-B (R is a rare earth element and T is one or more transition metal elements including Fe or Fe and Co) composition is a permanent magnet that has a structure including a main phase containing an $R_2T_{14}B$ phase of a composition formula of $R_2T_{14}B$ and a grain boundary phase containing an R-rich phase in which the content of R is larger than that of $R_2T_{14}B$. Such a rare earth magnet exerts excellent magnetic properties such as a high coercive force HcJ. An R-T-B rare earth permanent magnet is used as a high performance permanent magnet in motors and the like particularly requiring high performance, such as voice coil motors (VCM) for driving hard disk drive (HDD) heads, electric cars, and hybrid cars.

A rare earth permanent magnet contains R in the composition thereof and thus has high activity. However, R is easily oxidized to have low corrosion resistance, and therefore, various studies are conducted for improving the corrosion resistance. Typically, the surface of a rare earth magnet is plated with nickel (Ni) or other materials to increase corrosion resistance.

Improvement of the corrosion resistance of a rare earth permanent magnet itself is extremely important for making a rare earth magnet coated by plating or other methods be more reliable. Studied is improvement of the corrosion resistance of a rare earth magnet by typically adding an element such as Co and Cu as an element for improving the corrosion resistance.

Conventionally, for example, Japanese Laid-open Patent Publication No. 2003-31409 discloses a rare earth sintered magnet in which an intermediate phase containing Co and Cu of an atomic weight ratio of 30% to 60% is formed around an R-rich phase being present in a grain boundary triple point where a plurality of grain boundaries are merged. Thus, R in the R-rich phase in the grain boundary triple point is suppressed from being oxidized to improve the corrosion resistance.

However, the progress of corrosion cannot be sufficiently suppressed by simply covering the periphery of the R-rich phase being present in the grain boundary triple point with the intermediate phase containing Co and Cu because the grain boundary triple point includes a high proportion of the R-rich phase.

In other words, oxidation of R is suppressed from progressing toward the inside of the grain boundary phase by covering the periphery of the R-rich phase with the intermediate phase in the grain boundary triple point. However, when pinholes or the like occur in the region of the triple point on the surface of the magnet, oxidation of R cannot be sufficiently suppressed by simply covering the R-rich phase with the intermediate phase in the grain boundary triple point because the grain boundary triple point includes a high proportion of the R-rich phase. As a result, the oxidation of R may not be suppressed from progressing toward the inside of the grain boundary phase.

In recent years, rare earth sintered magnets have been increasingly used in automobiles, industrial equipment, or the like. Therefore, rare earth sintered magnets excellent in corrosion resistance are required in order to provide rare earth sintered magnets also available for such applications more stably.

SUMMARY OF THE INVENTION

A rare earth sintered magnet according to an aspect of the present invention includes a main phase that includes an $R_2T_{14}B$ phase of crystal grain where R is one or more rare earth elements including Nd, T is one or more transition metal elements including Fe or Fe and Co, and B is B or B and C; a grain boundary phase in which a content of R is larger than a content of the $R_2T_{14}B$ phase; and a grain boundary triple point that is surrounded by three or more main phases. The grain boundary triple point includes an R-rich phase containing R of 90 at % or more, and an R75 phase containing R of 60 at % to 90 at %, Co, and Cu. The relational expression $0.05 \leqq (Co+Cu)/R < 0.5$ is satisfied where (Co+Cu)/R is a composition ratio of R, Co, and Cu contained in the R75 phase in terms of atomic percentage. An area where a Co-rich region overlaps with a Cu-rich region in a cross-sectional area of the grain boundary triple point on a cross section of the rare earth sintered magnet is 60% or more.

The above and other features, advantages and technical and industrial significance of this invention will be better understood by reading the following detailed description of presently preferred embodiments of the invention, when considered in connection with the accompanying drawings.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION OF THE PREFERRED EMBODIMENTS

Figure 1:
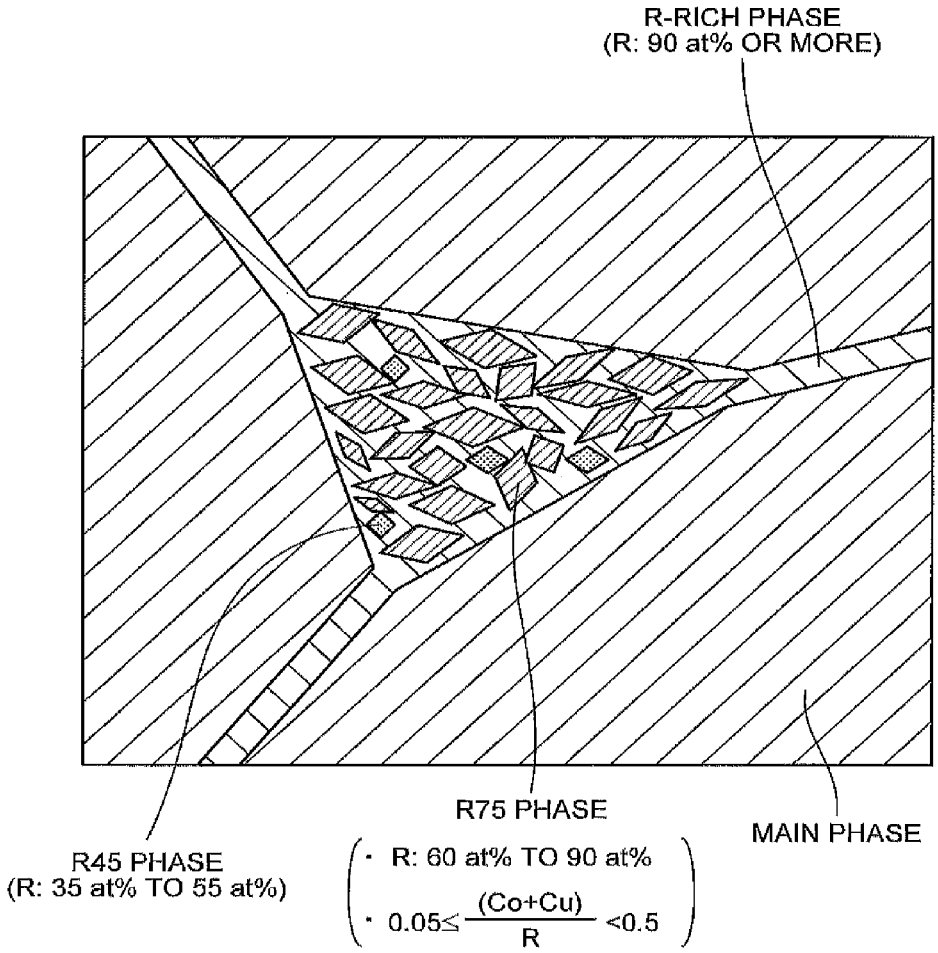
FIG. 1 is a schematic of a rare earth sintered magnet according to an embodiment of the present invention near a grain boundary triple point.

An embodiment for suitably performing the present invention (hereinafter, referred to as an embodiment) will be described in detail below. The present invention is not limited to the feature described in the following embodiment and examples. The components in the embodiment and examples include components of which the skilled person could have easily thought, substantially identical components, and components in the so-called equivalent range. Moreover, the components described in the embodiment and examples may be combined as appropriate or may be selected as appropriate to be used.

Rare Earth Sintered Magnet

A rare earth sintered magnet according to the present embodiment is a sintered body formed using an R-T-B alloy.

The rare earth sintered magnet according to the present embodiment includes: a main phase (crystal grain) including an $R_2T_{14}B$ phase whose crystal grain composition is represented by a composition formula of $R_2T_{14}B$ (R is one or more rare earth elements including Nd, T is one or more transition metal elements including Fe or Fe and Co, and B is B or B and C); a grain boundary phase in which the R content is larger than that of the $R_2T_{14}B$ phase; and a grain boundary triple point surrounded by three or more main phases. The grain boundary triple point includes an R-rich phase containing R of 90 at % or more, and an R75 phase containing R of 60 at % to 90 at %, Co, and Cu. In the grain boundary triple point, the composition ratio (Co+Cu)/R of R, Co, and Cu contained in the R75 phase satisfies Relational Expression (1) below in terms of atomic percentage, and an area where a Co-rich region overlaps with a Cu-rich region in the cross-sectional area of the grain boundary triple point on the cross section is 60% or more.

$$0.05 \leqq (Co+Cu)/R < 0.5 \quad (1)$$

R represents one or more rare earth elements. Rare earth elements mean Sc, Y, and lanthanoid elements belonging to the group 3 of the long-form periodic table. Examples of lanthanoid elements include La, Ce, Pr, Nd, Eu, Gd, Tb, Dy, Ho, Er, Tm, Yb, and Lu. Rare earth elements are classified into light rare earth elements and heavy rare earth elements. Heavy rare earth elements include Gd, Tb, Dy, Ho, Er, Tm, Yb, and Lu. Light rare earth elements include rare earth elements except for heavy rare earth elements. In view of production cost and magnetic properties, R preferably includes Nd.

T represents one or more transition metal elements including Fe or Fe and Co. T may be Fe alone, and a portion of Fe may be substituted with Co. When a portion of Fe is substituted with Co, the temperature properties can be improved without deteriorating the magnetic properties. The Co content is desirably suppressed at 20% or less by mass of the Fe content. This is because when a portion of Fe is substituted with Co so that the Co content becomes larger than the Fe content of 20% by mass, the magnetic properties may be deteriorated. Moreover, the rare earth sintered magnet becomes expensive. T may further include, besides Fe and Co, at least one of elements such as Al, Ga, Si, Ti, V, Cr, Mn, Ni, Cu, Zr, Nb, Mo, Hf, Ta, and W.

The grain boundary phase of the rare earth sintered magnet according to the present embodiment includes the R-rich phase in which the Nd content is larger than that of the $R_2T_{14}B$ phase, a Co-rich phase in which the Co content is larger than that of the $R_2T_{14}B$ phase, and a Cu-rich phase in which the Cu content is larger than that of the main phase. The grain boundary phase may include, besides the R-rich phase, a B-rich phase having a high B content. The grain size of the crystal grain is about 1 μm to 100 μm.

The R content in the rare earth sintered magnet according to the present embodiment is preferably in a range of 25% by mass to 35% by mass, and more preferably, of 28% by mass to 33% by mass. The B content is in a range of 0.5% by mass to 1.5% by mass, and preferably, of 0.8% by mass to 1.2% by mass. The balance is T except for Co and Cu.

The Co content is preferably, in a range of 0.6% by mass to 3.0% by mass, more preferably, of 0.7% by mass to 2.8% by mass, and further preferably, of 0.8% by mass to 2.5% by mass. This is because when the Co content falls below 0.6% by mass, the effect of improving the corrosion resistance according to the present embodiment may not be obtained. On the other hand, when the Co content exceeds 3.0% by mass, the magnetic properties of the rare earth sintered magnet may deteriorate to lead to cost increase. Accordingly, the magnetic properties can be maintained and the corrosion resistance can be improved by keeping the Co content in the range mentioned above, which is preferable.

The Cu content is preferably, in a range of 0.05% by mass to 0.5% by mass, more preferably, of 0.06% by mass to 0.4% by mass, and further preferably, of 0.07% by mass to 0.3% by mass. This is because when the Cu content falls below 0.05% by mass, the effect of improving the corrosion resistance of the rare earth sintered magnet may not be obtained. On the other hand, when the Cu content exceeds 0.5% by mass, the magnetic properties of the rare earth sintered magnet may deteriorate. Accordingly, the magnetic properties can be maintained and the corrosion resistance can be improved by keeping the Cu content in the range mentioned above, which is preferable.

Figure 2:
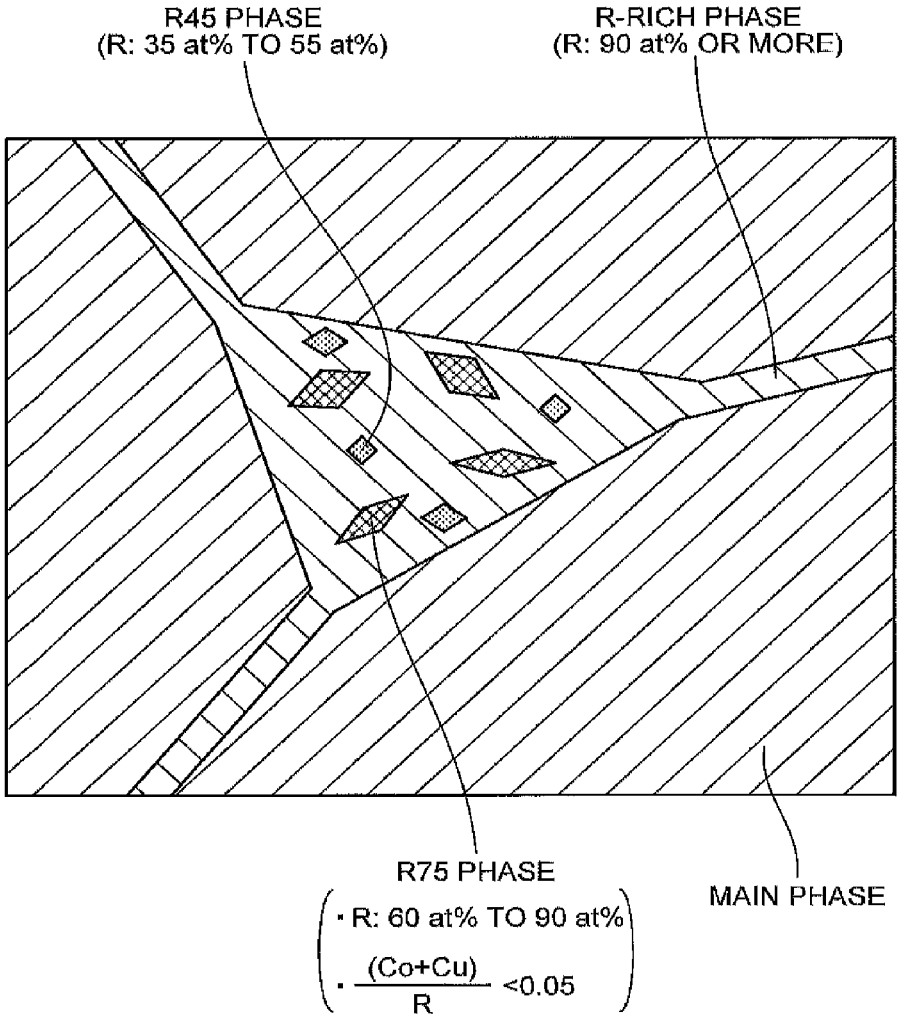
FIG. 2 is a schematic of a conventional rare earth sintered magnet near a grain boundary triple point.

In the rare earth sintered magnet according to the present embodiment, the grain boundary triple point is formed with the main phases. The grain boundary triple point includes a phase containing R the content of which is larger than that of the $R_2T_{14}B$ phase, Co, and Cu. FIG. 1 is a schematic of the rare earth sintered magnet according to the present embodiment near the grain boundary triple point, and FIG. 2 is a schematic of a conventional rare earth sintered magnet near the grain boundary triple point. As illustrated in FIGS. 1 and 2, the grain boundary triple point includes the R45 phase, the R75 phase, and the R-rich phase. The R45 phase is a phase containing R of 35 at % to 55 at %, preferably, of 40 at % to 50 at %, and further preferably, about 45 at %. The R75 phase is a phase containing R of 60 at % to 90 at %, preferably, of 70 at % to 80 at %, and further preferably, about 75 at %. The R-rich phase is a phase in which the R content is larger than that of the R75 phase and is larger than 90 at %. As illustrated in FIG. 1, the grain boundary triple point of the rare earth sintered magnet according to the present embodiment includes a high proportion of the R75 phase. In contrast, as illustrated in FIG. 2, the grain boundary triple point of the conventional rare earth sintered magnet includes a high proportion of the R-rich phase.

In the R75 phase of the rare earth sintered magnet according to the present embodiment, the composition ratio (Co+Cu)/R of R, Co, and Cu contained in the R75 phase satisfies Relational Expression (2) below, preferably, Relational Expression (3) below, and more preferably, Relational Expression (4) below in terms of atomic percentage.

$$0.05 \leqq (Co+Cu)/R < 0.50 \quad (3)$$

$$0.10 \leqq (Co+Cu)/R \leqq 0.40 \quad (4)$$

$$0.20 \leqq (Co+Cu)/R \leqq 0.30 \quad (5)$$

This is because when the composition ratio (Co+Cu)/R is not higher than 0.05, the redundant R-rich phase remains in the grain boundary triple point, and thus, the corrosion resistance of the rare earth sintered magnet cannot be improved. On the other hand, when the composition ratio (Co+Cu)/R exceeds 0.5, the magnetic properties of the rare earth sintered magnet deteriorates. Accordingly, the composition ratio (Co+Cu)/R satisfies Relational Expression (2) to enable the R content in the grain boundary triple point to decrease and the Co and Cu content to increase. Thus, the magnetic properties can be maintained and the corrosion resistance can be improved.

In contrast, as illustrated in FIG. 2, the grain boundary triple point of the conventional rare earth sintered magnet includes a high proportion of the R-rich phase, and therefore, the R content is large and the Co and Cu content is small. Accordingly, the composition ratio (Co+Cu)/R of R, Co, and Cu contained in the R75 phase in the grain boundary triple point is not higher than 0.05 in terms of atomic percentage.

The area where the Co-rich region overlaps with the Cu-rich region in the cross-sectional area of the grain boundary triple point on the cross section of the sintered body is preferably, 60% or more, and more preferably, 70% or more. When the area where the Co-rich region overlaps with the Cu-rich region falls below 60%, a high proportion of the R-rich phase remains in the region of the grain boundary triple point, and as a result, the corrosion resistance of the rare earth sintered magnet deteriorates as described above. When the area where the Co-rich region overlaps with the Cu-rich region is 60% or more, the ratio of R, Co, and Cu being present in the substantially same region in the grain boundary phase increases to enable further improvement of the corrosion resistance.

Typically, the surface of the rare earth sintered magnet is plated. However, when the surface of the conventional rare earth sintered magnet is plated, the corrosion reaction on the surface of the rare earth sintered magnet progresses due to hydrogen generated by the reaction between the plating solution and the grain boundary phase. Moreover, the flux decreases corresponding to the film thickness of the plating formed on the surface of the rare earth sintered magnet.

Figure 3:
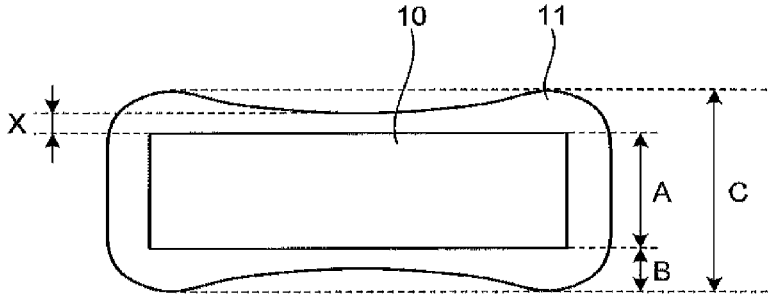
FIG. 3 is a cross-sectional schematic of a plated rare earth sintered magnet according to the present embodiment.

FIG. 3 is a cross-sectional schematic of a plated rare earth sintered magnet. As illustrated in FIG. 3, the whole surface of a rare earth sintered magnet 10 is covered with an Ni plated film 11. When the surface of the rare earth sintered magnet 10 is coated with the Ni plated film 11, the sum of a thickness A of the rare earth sintered magnet 10 and a thickness B of the Ni plated film 11 at both sides is a thickness C of an actual product. In the product, the thickness C of the product is set to be constant, and the rare earth sintered magnet 10 is covered with the Ni plated film 11 having a predetermined film thickness X. As a result, the flux of the rare earth sintered magnet 10 decreases corresponding to the corrosion of the surface of the rare earth sintered magnet 10 occurring when the surface of the rare earth sintered magnet 10 is plated and to the film thickness X of the Ni plated film 11 formed on the surface of the rare earth sintered magnet 10. The difference of the flux values before and after the rare earth sintered magnet 10 is plated with the Ni plated film 11 is called flux loss, and the thickness of the Ni plated film 11 with which the flux decreases by plating the rare earth sintered magnet 10 with the Ni plated film 11 is called plated film thickness loss.

In the rare earth sintered magnet according to the present embodiment, the grain boundary triple point includes a high proportion of the R75 phase; the composition ratio (Co+Cu)/R of R, Co, and Cu contained in the R75 phase satisfies Relational Expression (2) in terms of atomic percentage; and the area where the Co-rich region overlaps with the Cu-rich region in the cross-sectional area of the grain boundary triple point on the cross section of the sintered body is 60% or more. Therefore, the corrosion resistance is improved. Accordingly, even when the surface of the rare earth sintered magnet according to the present embodiment is plated to be covered, the amount of the R-rich phase being present at the grain boundary triple point decreases, and the phase containing a high proportion of Co and Cu increases. Thus, it is considered capable of suppressing the progress of the corrosion reaction due to hydrogen generated by the reaction between the plating solution and the grain boundary phase. Therefore, the corrosion resistance of the rare earth sintered magnet can be improved. This can reduce the damage at the contact portion between the rare earth sintered magnet and the plating to enable the rare earth sintered magnet to be suppressed from demagnetization. Moreover, even when the surface of the rare earth sintered magnet is plated, the flux generated in an early stage of the start of plating can be suppressed from decreasing.

Although the flux decreases by forming the plated film on the surface of the rare earth sintered magnet corresponding to the film thickness of the plated film, when the surface of the rare earth sintered magnet according to the present embodiment is plated, the flux generated in an early stage of the start of plating can be suppressed from decreasing. Therefore, the difference (flux loss) of the flux values of the rare earth sintered magnet before and after plating can be suppressed.

The Ni plated film 11 may be used as a coating layer of the rare earth sintered magnet 10 and may be a plated film formed containing Ni as Ni, Ni—B, Ni—P, or the like. The Ni plated film 11 may also be a metal plated film formed of a metal except for Ni. The metal plated film formed of a metal except for Ni is formed with a layer containing at least one of Cu, Zn, Cr, Sn, Ag, Au, and Al as a main component. These plated films are formed by, for example, electroplating and electroless plating. The plated films are preferably formed by electroplating. A plated film can be readily formed on the rare earth sintered magnet 10 by forming the plated film by electroplating. Electroplating enables a plated film to be formed safely at low cost with reproducibility as compared with the formation of a plated film by vacuum evaporation or other methods.

The rare earth sintered magnet according to the present embodiment is obtained by being formed into a predetermined intended shape by, for example, press molding. The shape of the rare earth sintered magnet 10 is not particularly limited and can be changed according to the shape of a mold to be used, for example, according to the shape of the rare earth sintered magnet of a flat shape, a column shape, a ring-shaped cross section, or other shapes.

The rare earth sintered magnet according to the present embodiment employs a rare earth sintered magnet containing an R-T-B alloy, but the present embodiment is not limited to this. For example, a compound (composition) for a rare earth bond magnet may be produced by kneading an R-T-B rare earth alloy powder and a resin binder, and a rare earth bond magnet produced by forming the obtained compound for a rare earth bond magnet into a predetermined shape may be used as a rare earth sintered magnet.

In the rare earth sintered magnet according to the present embodiment, the grain boundary triple point includes the R75 phase containing R of 60 at % to 90 at %, Co, and Cu, and the composition ratio (Co+Cu)/R of R, Co, and Cu contained in the R75 phase satisfies the above relational expressions in terms of atomic percentage. Moreover, the area where the Co-rich region overlaps with the Cu-rich region in the cross-sectional area of the grain boundary triple point on the cross section is 60% or more. Therefore, the rare earth sintered magnet according to the present embodiment can improve the corrosion resistance, and the flux loss of the rare earth sintered magnet after the plated film is formed can be suppressed by suppressing the decrease of the flux generated in an early stage of the start of plating.

Method for Producing a Rare Earth Sintered Magnet

Figure 4:
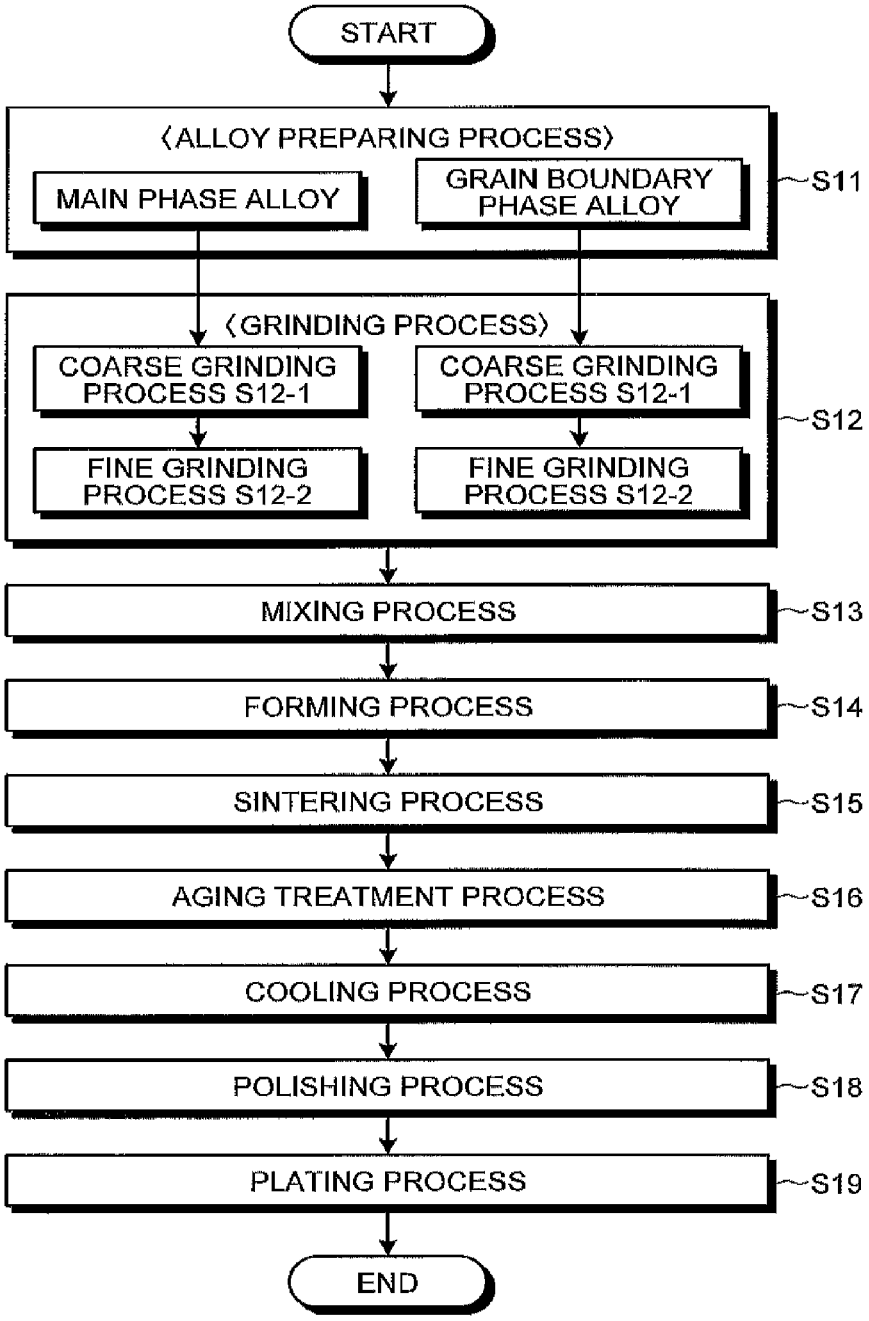
FIG. 4 is a flowchart of a method for producing the rare earth sintered magnet according to the present embodiment.

A suitable method for producing the rare earth sintered magnet having a structure as described above is described below with reference to the accompanying drawings. In the present embodiment, the powder of a main phase alloy includes $R1_2Fe_{14}B$ (R1 includes at least Nd and is one or more rare earth elements except for Dy) and inevitable impurities and excludes Co or Cu. The powder of a grain boundary phase alloy includes R2 (R2 includes at least Dy and is one or more rare earth elements except for Nd), Fe Co, and Cu. The method for producing the rare earth sintered magnet according to the present embodiment is described below that uses the powder of the main phase alloy and the powder of the grain boundary phase alloy. FIG. 4 is a flowchart of the method for producing the rare earth sintered magnet according to the embodiment of the present invention. As illustrated in FIG. 4, the method for producing the rare earth sintered magnet according to the present embodiment includes the following processes.

(a) an alloy preparing process for preparing a main phase alloy and a grain boundary phase alloy (Step S11)

(b) a grinding process for grinding the main phase alloy and the grain boundary phase alloy (Step S12)

(c) a mixing process for mixing the main phase alloy powder and the grain boundary phase alloy powder (Step S13)

(d) a forming process for forming the mixed power (Step S14)

(e) a sintering process for sintering the molded body (Step S15)

(f) an aging treatment process for subjecting the sintered body to aging treatment (Step S16)

(g) a cooling process for cooling the sintered body (Step S17)

(h) a polishing process for polishing the rare earth sintered magnet (Step S18)

(i) a plating process for plating the surface of the rare earth sintered magnet (Step S19)

Alloy Preparing Process: Step S11

A metal of a raw material is casted in a vacuum or in an inert gas atmosphere of an inert gas such as an Ar gas to obtain a main phase alloy and a grain boundary phase alloy (Step S11). In the present embodiment, the main phase alloy is adjusted so that the R1 content is in a range of 27% by mass to 33% by mass, the B content is in a range of 0.8% by mass to 1.2% by mass, and the balance is Fe. The grain boundary phase alloy is adjusted so that the R2 content is in a range of 25% by mass to 50% by mass, the Co content is in a range of 5% by mass to 50% by mass, and the Cu content is in a range of 0.3% by mass to 10% by mass. Rare earth metals or rare earth alloys, pure iron, ferroboron, alloys of them, and the like can be used for the metal of the raw material. Examples of the method for casting the metal of the raw material include an ingot casting method, a strip casting method, a book mold method, and a centrifugal casting method. When solidification segregation occurs in the obtained alloy of a raw material, the alloy is subjected to homogenization treatment if necessary. The homogenization treatment of the alloy of the raw material is performed at a temperature of 700° C. to 1500° C. for 1 hour or more in a vacuum or in an inert gas atmosphere. Thus, an alloy for a rare earth magnet is melted to be homogenized.

Grinding Process: Step S12

After the main phase alloy and the grain boundary phase alloy are produced at the alloy preparing process (Step S11), the main phase alloy and the grain boundary phase alloy are individually ground (Step S12). The main phase alloy and the grain boundary phase alloy may be ground together but more preferably are ground separately in terms of suppressing the composition deviation. The grinding process (Step S12) includes a coarse grinding process (Step S12-1) for grinding so that the grain size reaches about a few hundred micrometers and a fine grinding process (Step S12-2) for finely grinding so that the grain size reaches about a few micrometers.

Coarse Grinding Process: Step S12-1

The main phase alloy and the grain boundary phase alloy are individually coarsely ground so that the grain size reaches about a few hundred micrometers (Step S12-1). Thus, the coarsely ground powders of the main phase alloy and the grain boundary phase alloy are obtained. In the coarse grinding, hydrogen is occluded in the main phase alloy and the grain boundary phase alloy, and then, the hydrogen is released to perform hydrogen desorption to coarsely grind the main phase alloy and the grain boundary phase alloy. The coarse grinding may be performed using a stamp mill, a jaw crusher, a Braun mill, and similar apparatuses in an inert gas atmosphere.

To obtain high magnetic properties, atmosphere at each process from the grinding process (Step S12) to the sintering process (Step S15) is preferably in a low oxygen concentration. The oxygen content is adjusted by the control of the atmosphere at each production process, the control of the oxygen amount contained in the raw material, or other methods. The oxygen concentration at each process is preferably not higher than 3000 ppm.

Fine Grinding Process: Step S12-2

After the main phase alloy and the grain boundary phase alloy are coarsely ground at the coarse grinding process (Step S12-1), the coarsely ground powders of the main phase alloy and the grain boundary phase alloy are finely ground so that the grain size reaches about a few micrometers (Step S12-2). Thus, the ground powders of the main phase alloy and the grain boundary phase alloy are obtained. A jet milling is mainly used for the fine grinding, and the coarsely ground powders of the main phase alloy and the grain boundary phase alloy are ground so that the average grain size reaches about a few micrometers. Jet milling is a method for grinding by: releasing an inert gas ($N_2$ gas, for example) at high pressure through a narrow nozzle to generate high speed gas flow; and accelerating the coarsely ground powders of the main phase alloy and the grain boundary phase alloy with this high speed gas flow to cause collision between the coarsely ground powders of the main phase alloy and the grain boundary phase alloy or collision with the target or the vessel wall.

A grinding aid such as zinc stearate and oleic acid amide is added while the coarsely ground powders of the main phase alloy and the grain boundary phase alloy are finely ground, and thus, a finely ground powder having high orientation during forming can be obtained.

Mixing Process: Step S13

After the main phase alloy powder and the grain boundary phase alloy powder are produced at the fine grinding process (Step S12-2), the main phase alloy powder and the grain boundary phase alloy powder are mixed in a low oxygen atmosphere (Step S13). Thus, mixed powder is obtained. The low oxygen atmosphere is formed as, for example, an inert gas atmosphere such as $N_2$ gas or Ar gas atmosphere. The blending ratio of the main phase alloy powder and the grain boundary phase alloy powder is preferably, from 80:20 to 97:3, and more preferably, from 90:10 to 97:3 in a mass ratio.

The blending ratio when the main phase alloy and the grain boundary phase alloy are ground together at the grinding process (Step S12) is as with the blending ratio when the main phase alloy and the grain boundary phase alloy are separately ground. Therefore, the blending ratio of the main phase alloy powder and the grain boundary phase alloy powder is preferably, from 80:20 to 97:3, and more preferably, from 90:10 to 97:3 in a mass ratio.

Forming Process: Step S14

The mixed powder obtained by mixing the main phase alloy powder and the grain boundary phase alloy powder at the mixing process (Step S13) is formed (Step S14). The mixed powder is filled in a mold equipped with an electromagnet and then is formed in a magnet field in a state where the crystallographic axis is oriented by applying a magnetic field. Thus, a molded body is obtained. The obtained molded body is oriented in a specific direction, and thus, the rare earth sintered magnet 10 having stronger magnetic anisotropy is obtained. This forming in a magnetic field is preferably carried out at a pressure of approximately 0.7 t/cm$^2$ to 1.5 t/cm$^2$ (70 MPa to 150 MPa) in a magnetic field of 1.2 tesla or more. The magnetic field to be applied is not limited to a static magnetic field and can be a pulsed magnetic field. The static magnetic field and the pulsed magnetic field may also be used in combination.

The molded body is formed into an intended predetermined shape by, for example, press molding. The shape of the molded body obtained by forming the rare earth alloy powder is not particularly limited and can be changed according to the shape of the mold to be used, for example, according to the shape of the rare earth sintered magnet of a flat shape, a column shape, a ring-shaped cross section, or other shapes.

When the mixed powder of the main phase alloy powder and the grain boundary phase alloy powder is formed into an intended predetermined shape, the molded body formed by applying a magnetic field may be formed to be oriented in a certain direction. Thus, the rare earth sintered magnet is oriented in a specific direction, and as a result, the rare earth sintered magnet having stronger magnetic anisotropy is obtained.

Sintering Process: Step S15

After the mixed powder is formed in a magnetic field at the forming process (Step S14), the obtained molded body is sintered in a vacuum or in an inert gas atmosphere (Step S15). The sintering temperature is needed to be adjusted according to various conditions such as the composition, the grinding method, the grain size, and granular variation, and the sintering is carried out for example at a range of 900° C. to 1200° C. for a range of 1 hour to 10 hours. Thus, a sintered body is obtained.

Aging Treatment Process: Step S16

The sintered body obtained by sintering the molded body at the sintering process (Step S15) is subjected to aging process (Step S16). The aging treatment process (Step S16) is a process for adjusting the magnetic properties of the rare earth sintered magnet that is an end product by maintaining the sintered body obtained at the sintering at a temperature lower than that at the sintering to adjust the structure of the sintered body. In the aging treatment, the treatment conditions are adjusted as appropriate according to the number of aging treatments to be carried out. For example, 2-stage heating at a temperature of 700° C. to 900° C. for a range of 1 hour to 3 hours and further at a temperature of 500° C. to 700° C. for a range of 1 hour to 3 hours, or 1-stage heating at a temperature of about 600° C. for a range of 1 hour to 3 hours.

Cooling Process: Step S17

After the aging treatment is subjected to the sintered body at the aging treatment process (Step S16), the sintered body is rapidly cooled in a state of being pressurized with an Ar gas (Step S17). Thus, the rare earth sintered magnet according to the present embodiment can be obtained. The cooling speed is not particularly limited and is preferably equal to or larger than 30° C./min.

Polishing Process: Step S18

Barrel polishing is carried out on the rare earth sintered magnet according to the present embodiment obtained at the cooling process (Step S17) using a ball mill for about 2 hours to be chamfered (Step S18). The obtained rare earth sintered magnet may have a predetermined shape by being cut into a desired size or by smoothing the surface.

Plating Process: Step S19

After the rare earth sintered magnet is polished at the polishing process (Step S18), the surface of the rare earth sintered magnet according to the present embodiment is etched for a predetermined time using nitric acid. Subsequently, the surface of the rare earth sintered magnet according to the present embodiment is plated with Ni to form an Ni plated film thereon (Step S19).

As described above, in the rare earth sintered magnet according to the present embodiment, the grain boundary triple point includes the R75 phase containing R of 60 at % to 90 at %, Co, and Cu, and the composition ratio (Co+Cu)/R of R, Co, and Cu contained in the R75 phase is in a predetermined range in terms of atomic percentage. Moreover, the area where the Co-rich region overlaps with the Cu-rich region in the cross-sectional area of the grain boundary triple point on the cross section is 60% or more. Thus, the R-rich phase included in the grain boundary triple point can be reduced. Accordingly, the corrosion resistance of the rare earth sintered magnet according to the present embodiment can be improved. It is considered capable of suppressing the grain boundary component from being corroded by the plating solution to occlude hydrogen, and thus, the decrease of the flux generated in an early stage of the start of plating can be suppressed. Therefore, even when the Ni plated film is formed on the surface of the rare earth sintered magnet according to the present embodiment, the flux loss of the obtained rare earth sintered magnet can be suppressed. As a result, the plated film thickness loss due to the Ni plated film can be reduced to enable the production of the rare earth sintered magnet having high magnetic properties.

The C amount contained in the rare earth sintered magnet is adjusted according to the type, the additive amount, and the like of the grinding aid to be used in the production process. The N amount contained in the rare earth sintered magnet is adjusted according to the type and the amount of the alloy of the raw material, the grinding conditions when the alloy of the raw material is ground in a nitrogen atmosphere, and the like.

In the grinding of the main phase alloy and the grain boundary phase alloy, hydrogen is occluded in the main phase alloy and the grain boundary phase alloy, and then, the hydrogen is released to perform coarsely grinding, but the present embodiment is not limited to this. For example, the main phase alloy powder and the grain boundary phase alloy powder may be obtained by grinding the main phase alloy and the grain boundary phase alloy by the so-called hydrogenation decomposition desorption recombination (HDDR) method. The HDDR method is a method for making crystal fine by heating a raw material (starting alloy) in hydrogen to subject the raw material to hydrogenation decomposition (HD) and then by subjecting it to desorption recombination (DR).

The suitable embodiment of the rare earth sintered magnet according to the present embodiment is described above, but the rare earth sintered magnet according to the present embodiment is not limited to this. Various changes and modifications and various combinations can be made on the rare earth sintered magnet according to the present embodiment without departing from the gist of the invention. The rare earth sintered magnet is also applicable similarly to applications other than the permanent magnet.

EXAMPLES

The detail of the present invention is described below with reference to Examples and Comparative Example, but the present invention is not limited to the Examples.

1. Production of Rare Earth Sintered Magnet

Example 1

A main phase alloy 1 and a grain boundary phase alloy 1 having predetermined compositions were produced to produce a Nd—Fe—B sintered magnet having a predetermined magnet composition. Table 1 shows the compositions of the main phase alloy 1 and the grain boundary phase alloy 1 and the magnet composition of the Nd—Fe—B sintered magnet.

The main phase alloy 1 and the grain boundary phase alloy 1 having compositions shown in Table 1 were produced by a strip casting method. The mixture of the main phase alloy 1 and the grain boundary phase alloy 1 was subjected to hydrogen occlusion treatment at room temperature and then was subjected to hydrogen desorption treatment at 600° C. for 1 hour in an Ar atmosphere to coarsely grind the main phase alloy 1 and the grain boundary phase alloy 1. 0.1 wt % of oleic acid amide was added as a grinding aid to the coarsely ground main phase alloy 1 and grain boundary phase alloy 1, and the mixture was finely ground by a jet milling to produce fine powder having an average grain size of about 4.0 μm. The obtained main phase alloy powder and grain boundary phase alloy powder were mixed in a low oxygen atmosphere in a mass ratio of 95:5 to produce mixed powder. The obtained mixed powder was molded in a magnetic field at an applied magnetic filed of 1.5 tesla and a molding pressure of 1.2 ton/cm$^2$ to produce a molded body. The obtained molded body was maintained at 1040° C. for 4 hours in a vacuum to be sintered. Subsequently, aging treatment was performed in an Ar atmosphere to perform heat treatment to obtain a sintered body. The aging treatment was performed in 2 stages. The sintered body was maintained at 800° C. for 1 hour and then was maintained at 550° C. for 1 hour. The cooling speed during temperature decreasing process (from 1040° C. to 800° C.) from the completion of the sintering in an Ar atmosphere to the first stage of the aging treatment was 50° C./min. The cooling speed during temperature decreasing process (from 800° C. to 550° C.) from the first stage to the second stage of the aging treatment was 50° C./min. Barrel polishing was carried out on the rare earth sintered magnet obtained by the aging treatment using a ball mill for 2 hours to be chamfered. Subsequently, etching was performed using nitric acid for a desired time, and then Ni plating was performed.

TABLE 1

| | | Composition (mass %) | | | | | | | | Mass |
|---|---|---|---|---|---|---|---|---|---|---|
| | | Nd | Dy | (T, RE) | Co | Al | Cu | B | Fe | ratio |
| Example 1 | Main phase alloy 1 | 30.60 | 0.00 | 0.00 | 0.00 | 0.18 | 0.00 | 1.06 | bal. | 95 |
| | Grain boundary phase alloy 1 | 0.00 | 39.60 | 39.60 | 30.00 | 0.18 | 3.00 | 0.00 | bal. | 5 |
| | Magnet Composition | 29.05 | 1.98 | 31.03 | 1.50 | 0.18 | 0.15 | 1.01 | bal. | |

Examples 2 and 3 and Comparative Example 1

Examples 2 and 3 and Comparative Example 1 were performed in a manner similar to Example 1 except that main phase alloys 2 to 4 were used whose compositions were similar to the composition of the main phase alloy 1 used in Example 1, and grain boundary phase alloys 2 to 4 were used whose compositions were changed from the composition of the grain boundary phase alloy 1 used in Example 1 to obtain a rare earth sintered body. Table 2 shows the compositions and mass ratios of the main phase alloy 2 and the grain boundary phase alloy 2 and the magnet composition of the obtained Nd—Fe—B sintered magnet. Table 3 shows the compositions and mass ratios of the main phase alloy 3 and the grain boundary phase alloy 3 and the magnet composition of the obtained Nd—Fe—B sintered magnet. Table 4 shows the compositions and mass ratios of the main phase alloy 4 and the grain boundary phase alloy 4 and the magnet composition of the obtained Nd—Fe—B sintered magnet.

TABLE 2

| | | Composition (mass %) | | | | | | | | Mass |
|---|---|---|---|---|---|---|---|---|---|---|
| | | Nd | Dy | (T, RE) | Co | Al | Cu | B | Fe | ratio |
| Example 2 | Main phase alloy 2 | 30.60 | 0.00 | 0.00 | 0.00 | 0.18 | 0.00 | 1.06 | bal. | 95 |
| | Grain boundary phase alloy 2 | 0.00 | 39.60 | 39.60 | 50.00 | 0.18 | 10.00 | 0.00 | bal. | 5 |
| | Magnet Composition | 29.05 | 1.98 | 31.03 | 2.50 | 0.18 | 0.50 | 1.01 | bal. | |

TABLE 3

| | | Composition (mass %) | | | | | | | | Mass |
|---|---|---|---|---|---|---|---|---|---|---|
| | | Nd | Dy | (T, RE) | Co | Al | Cu | B | Fe | ratio |
| Example 3 | Main phase alloy 3 | 30.60 | 0.00 | 0.00 | 0.00 | 0.18 | 0.00 | 1.06 | bal. | 95 |
| | Grain boundary phase alloy 3 | 0.00 | 39.60 | 39.60 | 12.00 | 0.18 | 1.00 | 0.00 | bal. | 5 |
| | Magnet Composition | 29.05 | 1.98 | 31.03 | 0.60 | 0.18 | 0.05 | 1.01 | bal. | |

TABLE 4

| | | Composition (mass %) | | | | | | | | Mass |
|---|---|---|---|---|---|---|---|---|---|---|
| | | Nd | Dy | (T, RE) | Co | Al | Cu | B | Fe | ratio |
| Comparative Example 1 | Main phase alloy 4 | 30.60 | 0.00 | 0.00 | 0.00 | 0.18 | 0.00 | 1.06 | bal. | 95 |
| | Grain boundary phase alloy 4 | 0.00 | 39.60 | 39.60 | 10.20 | 0.18 | 1.20 | 0.00 | bal. | 5 |
| | Magnet Composition | 29.05 | 1.98 | 31.03 | 0.51 | 0.18 | 0.06 | 1.01 | bal. | |

2. Evaluation

Elemental mapping

Electron Probe Microanalyzer (EPMA)

Figure 5:
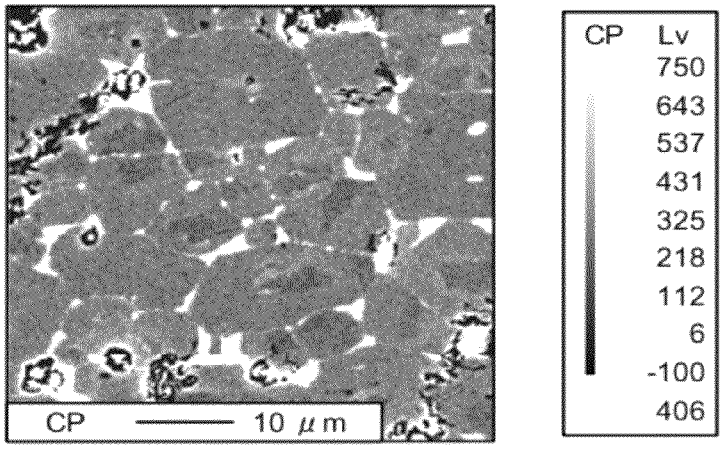
FIG. 5 is a composition image of a rare earth sintered magnet of Example 1.
Figure 6:
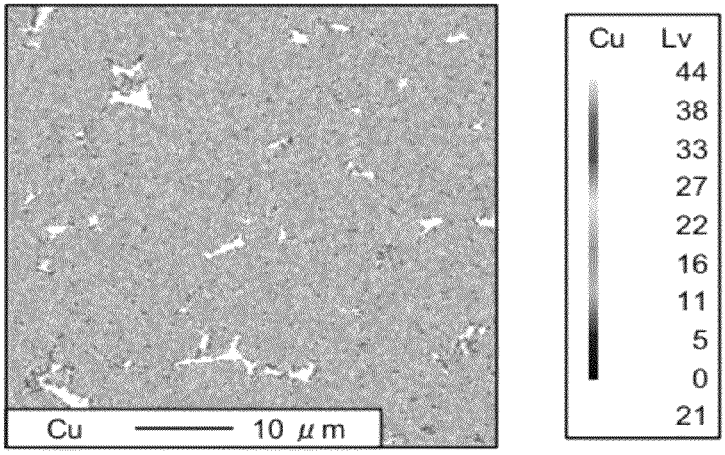
FIG. 6 is an observation result of Cu in the rare earth sintered magnet of Example 1 using an electron probe microanalyzer (EPMA)
Figure 7:
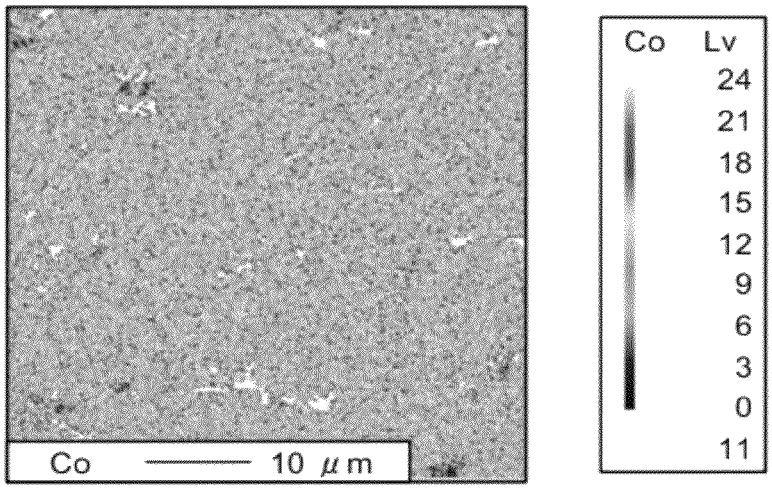
FIG. 7 is an observation result of Co in the rare earth sintered magnet of Example 1 using the EPMA.
Figure 8:
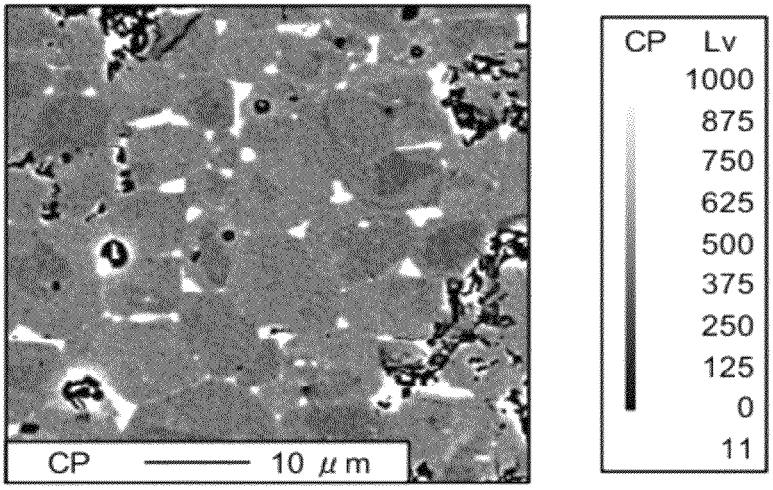
FIG. 8 is a composition image of a rare earth sintered magnet of Comparative Example 1.
Figure 9:
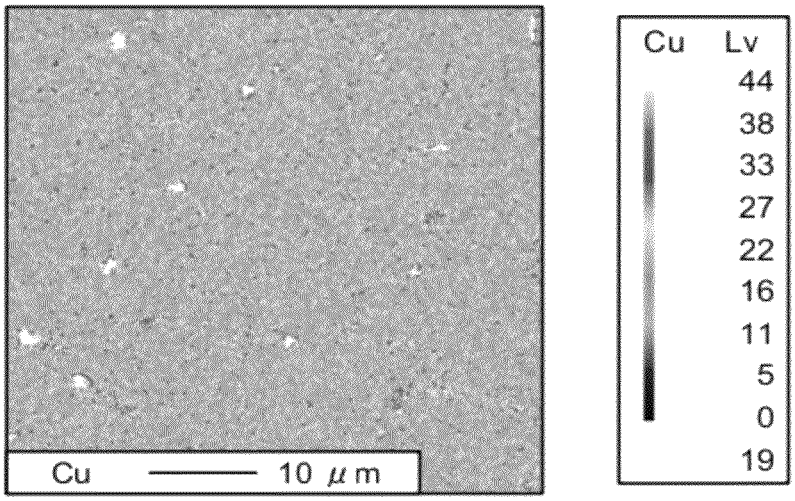
FIG. 9 is an observation result of Cu in the rare earth sintered magnet of Comparative Example 1 using the EPMA.
Figure 10:
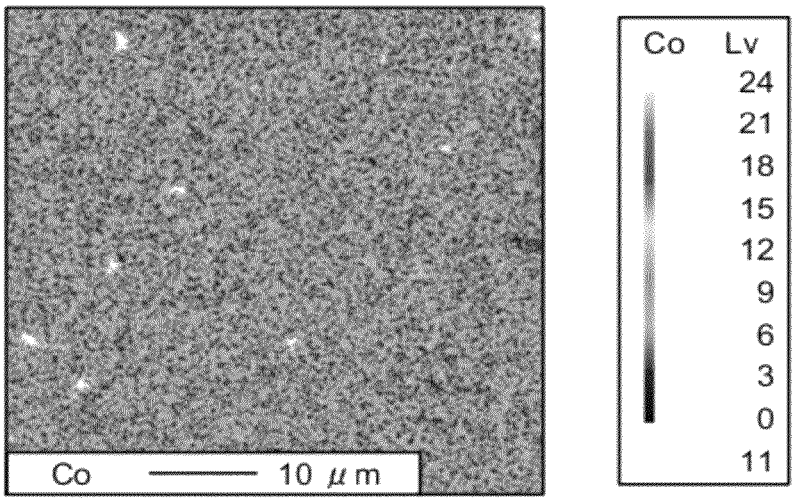
FIG. 10 is an observation result of Co in the rare earth sintered magnet of Comparative Example 1 using the EPMA.

For confirming the position of the Cu and Co-rich regions in the grain boundary triple point, the structures of the rare earth sintered magnets of Examples 1 to 3 and the rare earth sintered magnet of Comparative Example 1 were observed using an EPMA to perform elemental mapping with the EPMA. FIG. 5 is a composition image of the rare earth sintered magnet of Example 1. FIG. 6 is an observation result of Cu in the rare earth sintered magnet of Example 1 using an EPMA. FIG. 7 is an observation result of Co in the rare earth sintered magnet of Example 1 using an EPMA. FIG. 8 is a composition image of the rare earth sintered magnet of Comparative Example 1. FIG. 9 is an observation result of Cu in the rare earth sintered magnet of Comparative Example 1 using an EPMA. FIG. 10 is an observation result of Co in the rare earth sintered magnet of Comparative Example 1 using an EPMA. Elemental mapping with an EPMA was performed on Examples 2 and 3 in a similar manner by observing with an EPMA. Table 5 shows an area ratio of a region where a Co-rich region overlaps with a Cu-rich region of Examples 1 to 3 and Comparative Example 1.

TABLE 5

| | Area ratio (%) |
|---|---|
| Example 1 | 88 |
| Example 2 | 93 |

TABLE 5-continued

| | Area ratio (%) |
|---|---|
| Example 3 | 67 |
| Comparative example 1 | 54 |

FIGS. 5 and 8 indicate that the white portion has higher concentration of the elements. Typically, the main phase rarely has the concentration distribution, and thus, it is recognized as that the white region with high concentration corresponds to the grain boundary phase. As illustrated in FIGS. 6 and 7, in the Nd-rich grain boundary triple point, the Co-rich region almost overlapped with the Cu-rich region in Example 1, and as shown in Table 5, the area ratio of the region where the Cu-rich region overlapped with the Co-rich region was about 88%. As shown in Table 5, the area ratio of the region where the Cu-rich region overlapped with the Co-rich region was about 93% in Example 2, and the area ratio of the region where the Cu-rich region overlapped with the Co-rich region was about 67% in Example 3. In contrast, as illustrated in FIGS. 9 and 10, in the Nd-rich grain boundary triple point, some of the Co-rich region and the Cu-rich region were partially separately present in Comparative Example 1, and as shown in Table 5, the area ratio of the region where the Cu-rich region overlapped with the Co-rich region was about 54%.

Scanning Transmission Electron Microscope-Energy Dispersive X-Ray Spectroscopy (STEM-EDS)

Figure 11:
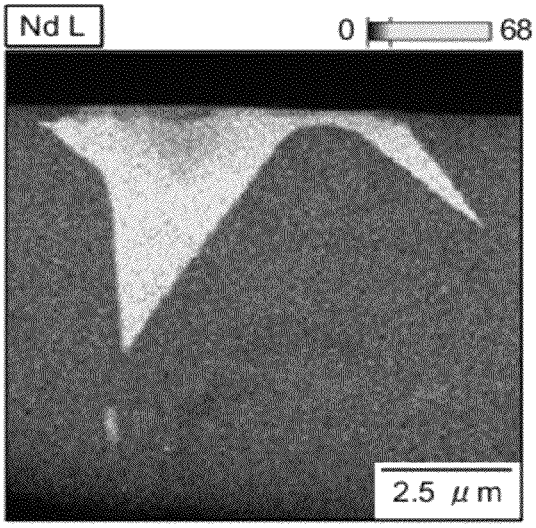
FIG. 11 is an observation result of Nd in the rare earth sintered magnet of Example 1 using scanning transmission electron microscope-energy dispersive X-ray spectroscopy (STEM-EDS)
Figure 12:
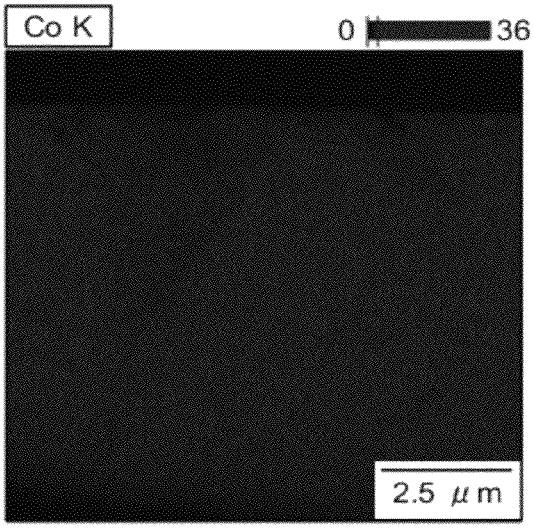
FIG. 12 is an observation result of Co in the rare earth sintered magnet of Example 1 using STEM-EDS.
Figure 13:
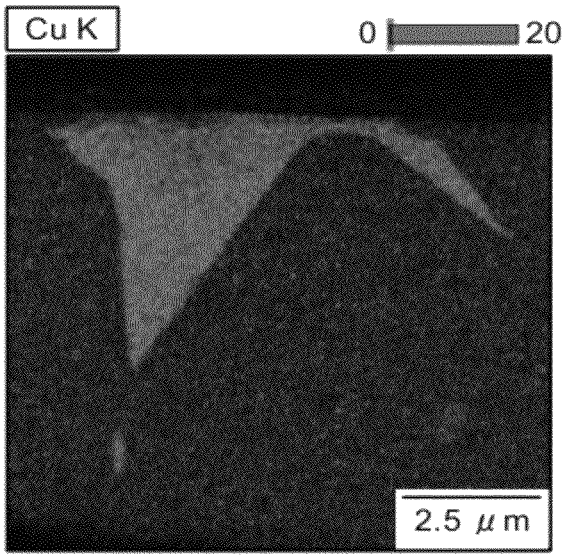
FIG. 13 is an observation result of Cu in the rare earth sintered magnet of Example 1 using STEM-EDS.
Figure 14:
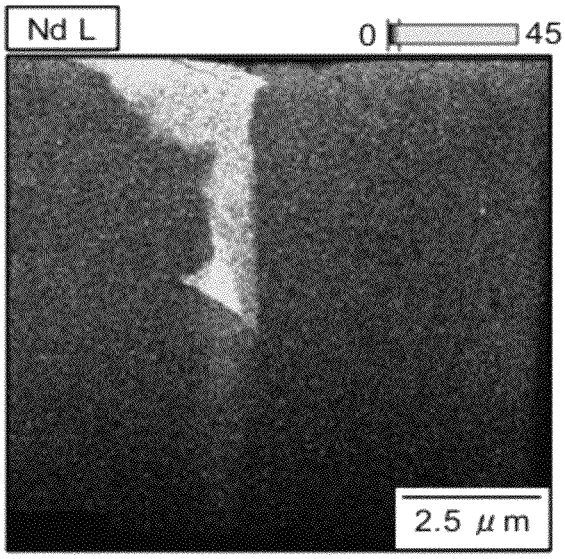
FIG. 14 is an observation result of Nd in the rare earth sintered magnet of Comparative Example 1 using STEM-EDS.
Figure 15:
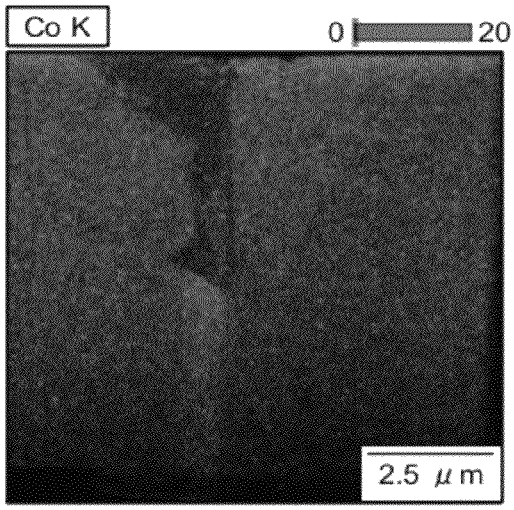
FIG. 15 is an observation result of Co in the rare earth sintered magnet of Comparative Example 1 using an STEM-EDS.
Figure 16:
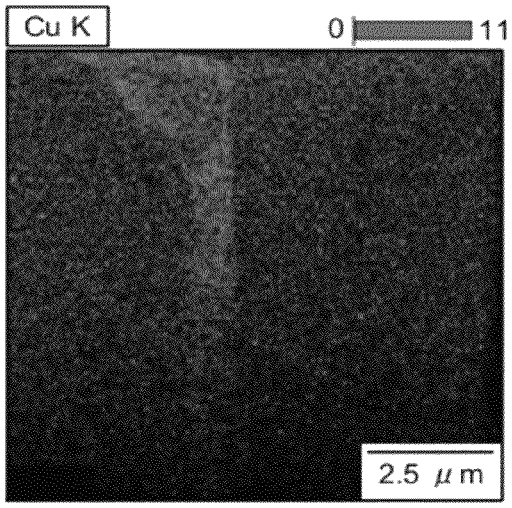
FIG. 16 is an observation result of Cu in the rare earth sintered magnet of Comparative Example 1 using an STEM-EDS.

For confirming the position of the Nd, Cu and Co-rich regions in the grain boundary triple point, observation was performed using an STEM-EDS. The structures of the rare earth sintered magnets of Examples 1 to 3 and the rare earth sintered magnet of Comparative Example 1 were observed using an STEM-EDS, and the results obtained by performing elemental mapping with the STEM-EDS are indicated in FIGS. 11 to 16. FIG. 11 is an observation result of Nd in the rare earth sintered magnet of Example 1 using an STEM-EDS. FIG. 12 is an observation result of Co in the rare earth sintered magnet of Example 1 using an STEM-EDS. FIG. 13 is an observation result of Cu in the rare earth sintered magnet of Example 1 using an STEM-EDS. FIG. 14 is an observation result of Nd in the rare earth sintered magnet of Comparative Example 1 using an STEM-EDS. FIG. 15 is an observation result of Co in the rare earth sintered magnet of Comparative Example 1 using an STEM-EDS. FIG. 16 is an observation result of Cu in the rare earth sintered magnet of Comparative Example 1 using an STEM-EDS. Table 6 shows the composition ratio (Co Cu)/R (where R is Nd) of R, Co, and Cu in terms of atomic percentage of Examples 1 to 3 and Comparative Example 1.

TABLE 6

| | (Co + Cu)/R |
|---|---|
| Example 1 | 0.21 to 0.35 |
| Example 2 | 0.28 to 0.45 |
| Example 3 | 0.07 to 0.09 |
| Comparative example 1 | 0.034 |

As illustrated in FIGS. 11 to 13, in the elemental mapping with an STEM-EDS, a structure where a larger amount of Nd, Co, and Cu were segregated was observed in the grain boundary triple point of the rare earth sintered magnet of Example 1 as compared with the rare earth sintered magnet of Comparative Example 1. At this time, the point analysis of the composition in the grain boundary triple point was performed. As a result, found was that both of the rare earth sintered magnets of Example 1 and Comparative Example 1 included a phase (R-rich phase) containing Nd of 90% or more, and a phase (R45 phase) containing Nd of 35 at % to 55 at %, Fe of about 45 at %, and Co and Cu, both of which were of about 2 at %. A phase (R75 phase) containing Nd of 60 at % to 90 at %, Fe of about 2 at %, Co of 9 at % to 19 at %, and Cu of about 7 at % was also found in Example 1. In contrast, a phase (R75 phase) containing Nd of 60 at % to 90 at %, Fe of about 22 at %, Al of about 1.5 at %, Co of about 1 at %, and Cu of about 1.5 at % was found in Comparative Example 1. As shown in Table 6, the composition ratio (Co+Cu)/R of R, Co, and Cu contained in the R75 phase of the rare earth sintered magnet of Example 1 was in a range of 0.21 to 0.35 in terms of atomic percentage.

The observation results of the rare earth sintered magnet of Example 1 using an EPMA and an STEM-EDS are combined to schematically illustrate the state of the grain boundary triple point of the rare earth sintered magnet of Example 1, which can be illustrated as FIG. 1. As illustrated in FIG. 1, the grain boundary triple point of the rare earth sintered magnet of Example 1 included a high proportion of an R75 phase containing Nd of 60 at % to 90 at %. The composition ratio (Co+Cu)/R of R, Co, and Cu contained in this R75 phase can be said to be in a range of 0.05 to 0.5 in terms of atomic percentage.

The R75 phases were found also in the grain boundary triple points of the rare earth sintered magnets of Examples 2 and 3. The composition ratio (Co+Cu)/R of R, Co, and Cu contained in the R75 phase in the grain boundary triple point of the rare earth sintered magnet of Example 2 was in a range of 0.28 to 0.45 in terms of atomic percentage. The composition ratio (Co+Cu)/R of R, Co, and Cu contained in the R75 phase in the grain boundary triple point of the rare earth sintered magnet of Example 3 was in a range of 0.07 to 0.09 in terms of atomic percentage. The grain boundary triple points of the rare earth sintered magnets of Examples 2 and 3 also included a high proportion of the R75 phases. The composition ratio (Co+Cu)/R of R, Co, and Cu contained in each of these R75 phases can be said to be in a range of 0.05 to 0.5 in terms of atomic percentage.

In contrast, the observation results of the rare earth sintered magnet of Comparative Example 1 using an EPMA and an STEM-EDS are combined to schematically illustrate the state of the grain boundary triple point, which can be illustrated as FIG. 2. As illustrated in FIG. 2, although the grain boundary triple point of the rare earth sintered magnet of Comparative Example 1 also included the R75 phase, the composition ratio (Co+Cu)/R of R, Co, and Cu contained in the R75 phase of the rare earth sintered magnet of Comparative Example 1 was about 0.034 in terms of atomic percentage.

Accordingly, the composition ratio (Co+Cu)/R of R, Co, and Cu contained in the R75 phase in the grain boundary triple point of the rare earth sintered magnet of Comparative Example 1 was smaller than that of each of the rare earth sintered magnets of Examples 1 to 3 in terms of atomic percentage. Accordingly, it was found that the amount of Co and Cu contained in the R75 phase in the grain boundary triple point of the rare earth sintered magnet of Comparative Example 1 was smaller than that of each of the rare earth sintered magnets of Examples 1 to 3.

Evaluation of Corrosion Resistance

Figure 17:
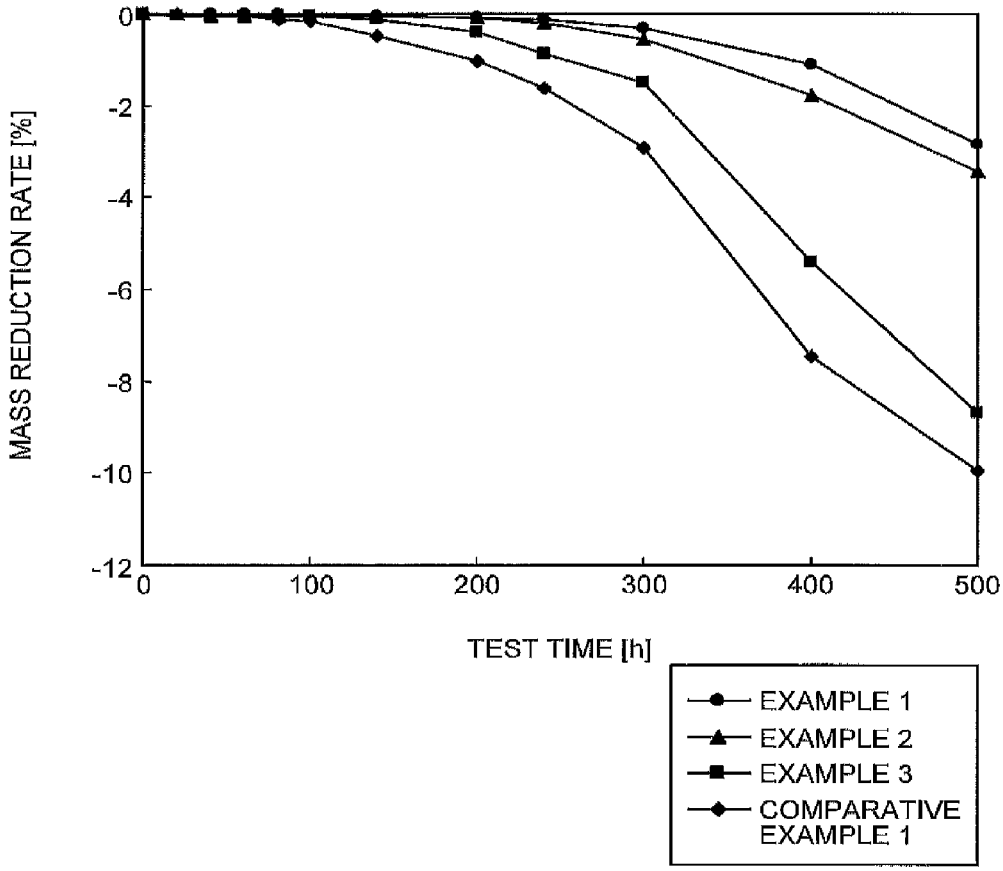
FIG. 17 is a graph of a measurement result of corrosion resistance obtained using an unsaturated pressure cooker test (PCT) machine according to the present embodiment.

A rare earth sintered magnet on which only etching was performed without being plated with Ni was used as a sample. This sample was made to be corroded using an unsaturated pressure cooker test (PCT) machine under a condition of 120° C., 2 atmospheric pressures, and 100% RH, and the corroded portion of the surface of the rare earth sintered magnet was removed to obtain a mass reduction rate per unit area of the rare earth sintered magnet. FIG. 17 is a graph of a measurement result of corrosion resistance obtained using a PCT machine. As illustrated in FIG. 17, the mass change of Examples 1 to 3 was smaller than that of Comparative Example 1. Therefore, it was found that the decrease in the R-rich phase proportion by increasing the contents of Co and Cu in the grain boundary triplet point contributed to the improvement of the corrosion resistance of the rare earth sintered magnet.

Evaluation of Flux Loss

Figure 18:
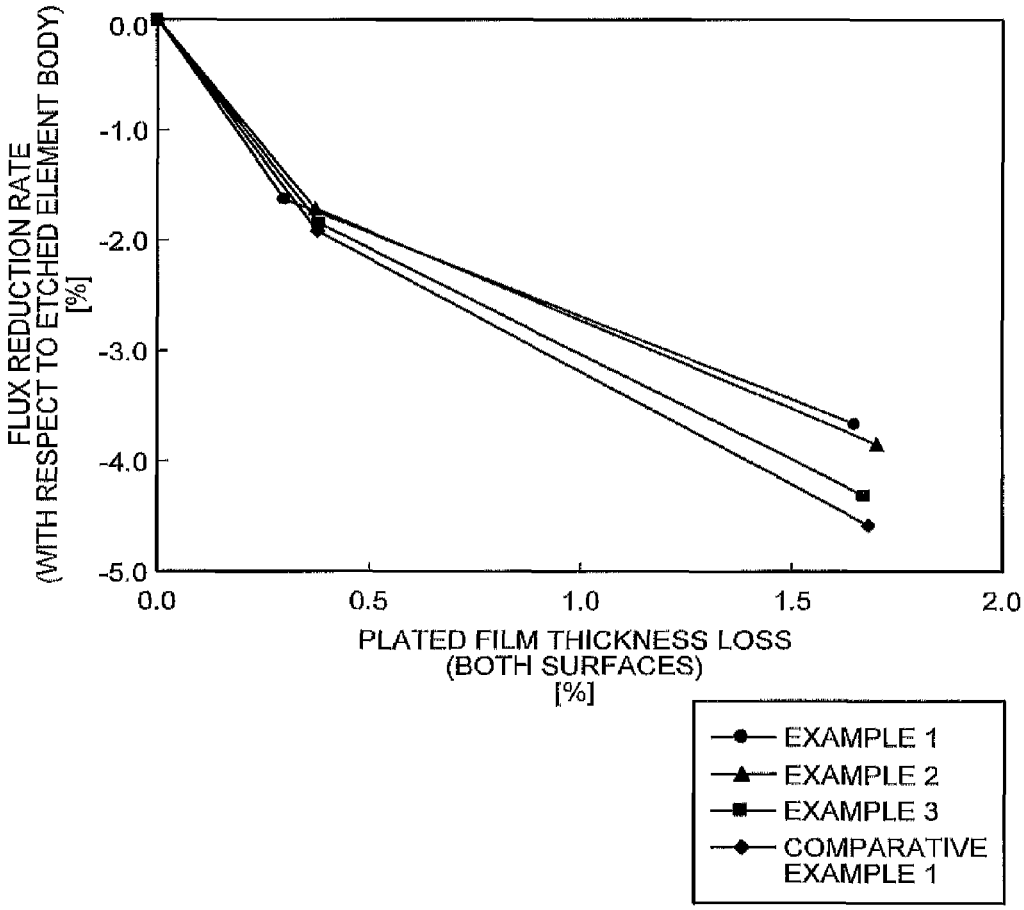
FIG. 18 is a graph indicating a measurement result of flux according to the present embodiment.

A rare earth sintered magnet plated with Ni and a rare earth sintered magnet on which only etching was performed were subjected to pulse magnetization, and the open fluxes of them were measured using a magnetic flux measuring apparatus with a winding number of the coil of 250. The reduction rate of the flux value of the rare earth sintered magnet plated with Ni was measured with reference to the flux value of the rare earth sintered magnet on which only etching was performed. As described above, the difference of the flux values before and after Ni plating is called flux loss. FIG. 18 is a graph indicating a measurement result of flux. As indicated in FIG. 18, the plated film thickness loss at both surfaces of the rare earth sintered magnet when the surfaces were plated with Ni having a film thickness of about 4 μm was about 1.6%. In this case, the flux loss of Comparative Example 1 was about 4.5% when the film thickness of Ni plated on both surfaces of the rare earth sintered magnet was about 20 μm. In contrast, the flux loss in Examples 1 to 3 was suppressed to about 3% to 4%. Therefore, it was found that the use of the rare earth sintered magnet according to the present embodiment enabled the suppression of the flux loss.

As described above, despite the fact that the composition and the basic production method of each of the rare earth sintered magnets of Examples 1 to 3 correspond to those of the rare earth sintered magnet of Comparative Example 1, they had different corrosion resistances and flux losses. The rare earth sintered magnets of Examples 1 to 3 were able to improve the corrosion resistance and to suppress the decrease of the flux generated in an early stage of the start of plating as compared with the rare earth sintered magnet of Comparative Example 1. This is recognized as that whether the area where the Co-rich region overlaps with the Cu-rich region in the cross-sectional area of the grain boundary triple point on the cross section is a predetermined value or larger affects the suppression of the decrease in the corrosion resistance and the flux of the rare earth sintered magnet in the following structure. The grain boundary triple point includes the R75 phase, and the composition ratio (Co+Cu)/R of R, Co, and Cu contained in the R75 phase is set in a predetermined range in terms of atomic percentage so as to include Co and Cu to reduce the ratio of the R-rich phase in the grain boundary triple point. Accordingly, it was found that, as the rare earth sintered magnet according to the present embodiment, a rare earth sintered magnet whose corrosion resistance was improved and flux loss was suppressed were able to be produced.

A rare earth sintered magnet according to the present invention is useful for, for example, a permanent magnet used in VCMs for driving an HOD head, electric cars, hybrid cars, and the like.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A rare earth sintered magnet comprising:

a main phase that includes an $R_2T_{14}B$ phase of crystal grain where

R is one or more rare earth elements,

T is Fe or Fe and Co, and

B is B or B and C;

a grain boundary phase in which a content of R is larger than a content of the $R_2T_{14}B$ phase; and a grain boundary triple point that is surrounded by three or more main phases, wherein the grain boundary triple point includes an R-rich phase containing R of 90 at % or more, and an R75 phase containing R of 60 at % to 90 at %, Co, and Cu, $0.05 \leqq (Co+Cu)/R < 0.45$ is satisfied where (Co+Cu)/R is a composition ratio of R, Co, and Cu contained in the R75 phase in terms of atomic percentage, and an area where a Co-rich region overlaps with a Cu-rich region in a cross-sectional area of the grain boundary triple point on a cross section of the rare earth sintered magnet is 60% or more.

2. The rare earth sintered magnet according to claim 1, wherein a content of R in a magnet composition is of 25% by mass to 35% by mass.

3. The rare earth sintered magnet according to claim 1, wherein a content of Co in a magnet composition is of 0.6% by mass to 3.0% by mass.

4. The rare earth sintered magnet according to claim 1, wherein a content of Cu in a magnet composition is 0.05% by mass to 0.5% by mass.

* * * * *